US005836472A

United States Patent [19]

Vavra et al.

[11] Patent Number: 5,836,472

[45] Date of Patent: Nov. 17, 1998

[54] ALL POLY CONTAINER WITH SEPARABLE TANK AND PALLET MEMBERS

[75] Inventors: Elaine K. Vavra, Crete; Dwight E. Nichols, Beatrice, both of Nebr.

[73] Assignee: Hoover Group, Inc., Alpharetta, Ga.

[21] Appl. No.: 736,510

[22] Filed: Oct. 24, 1996

[51] Int. Cl.[6] ..... B65D 21/00

[52] U.S. Cl. ..... 220/571; 220/1.5

[58] Field of Search ..... 220/571, 1.5, 4.12

[56] References Cited

U.S. PATENT DOCUMENTS

| | | | |
|---|---|---|---|
| 4,887,731 | 12/1989 | Pett et al. | 220/1.5 |
| 5,110,000 | 5/1992 | Nichols | 220/1.5 X |
| 5,197,601 | 3/1993 | Sterett | 220/1.5 X |
| 5,253,776 | 10/1993 | Decroix et al. | 220/1.5 X |
| 5,253,777 | 10/1993 | Schutz | 220/571 |

*Primary Examiner*—Steven M. Pollard
*Attorney, Agent, or Firm*—Harness, Dickey & Pierce, P.L.C.

[57] ABSTRACT

A container for bulk liquid storage consisting of a tank member with lifting surfaces and a pallet having downwardly facing surfaces. The lifting surfaces and the downwardly facing surfaces are substantially in vertical alignment with each other and interfit together with removably mounted structural members in between them to hold the tank member and the pallet together. The tank member is structured to thoroughly drain through a discharge port without any additional action by the user. The container is made from a corrosion resistant material and is easy to assemble and disassemble.

9 Claims, 3 Drawing Sheets

ALL POLY CONTAINER WITH SEPARABLE TANK AND PALLET MEMBERS

BACKGROUND AND SUMMARY OF THE INVENTION

1. FIELD OF THE INVENTION

The present invention relates generally to containers for bulk liquids and more specifically to a container consisting of an interfitting tank member and pallet which are held together by structural members, wherein the tank member is designed to drain without tipping.

2. BACKGROUND INFORMATION

Containers made for bulk liquids are usually metal drums. Sometimes they consist of an inner resin or poly container which is enclosed by an outer shell of sheet metal, a metal cage or other material. The inner container member is filled with a liquid or other material for transport or storage, and the composite container is placed on a pallet made of wood or metal. The pallets are normally designed to allow forklift handling through pockets placed in the boxlike structures.

While this type of container is safe for both hazardous and non-hazardous liquids, there is a need for an all plastic container to avoid corrosion due to either environmental conditions, or contact with the contents of the container. Containers can be heavy and difficult to maneuver and assembly is often difficult as the containers have numerous parts. Also, this type of container requires frequent maintenance as parts corrode or wear out. A further problem is that the draining system on the container often requires a user to tip the heavy container to thoroughly drain the container.

SUMMARY OF THE INVENTION

It is an object of the present invention to provide a container consisting of a tank member and a pallet which interfit for assembly purposes and can be separated for maintenance and recycling.

It is a further object of the present invention to provide a container with a tank member that thoroughly drains without action from the user.

It is another object of the present invention to design a container made from a corrosion resistant material.

It is a further object of the present invention to provide a tank and pallet assembly that requires little maintenance and is easy to assemble and disassemble.

The above objects are satisfied by the present invention of an all poly container composed of an interfitting tank member and a pallet held together with two structural members. The poly material is corrosion resistant and lightweight. The all poly container is easy to assemble and disassemble, and can quickly be assembled by one person. Little maintenance is required for the container.

The tank member is designed to drain completely without action from the user. The pallet has an upper surface which is designed to interfit with the specially designed tank member. The pallet is also designed to allow forklift access for transporting the container. After the tank member is placed on the pallet, the two structural members are added to hold together the interfitting tank member and pallet.

Additional objects, benefits and advantages of the present invention will become apparent from studying the subsequent drawings of the preferred embodiment and the appended claims, taken in conjunction with the accompanying drawings.

DETAILED DESCRIPTION OF THE PREFERRED EMBODIMENT

Figure 1:
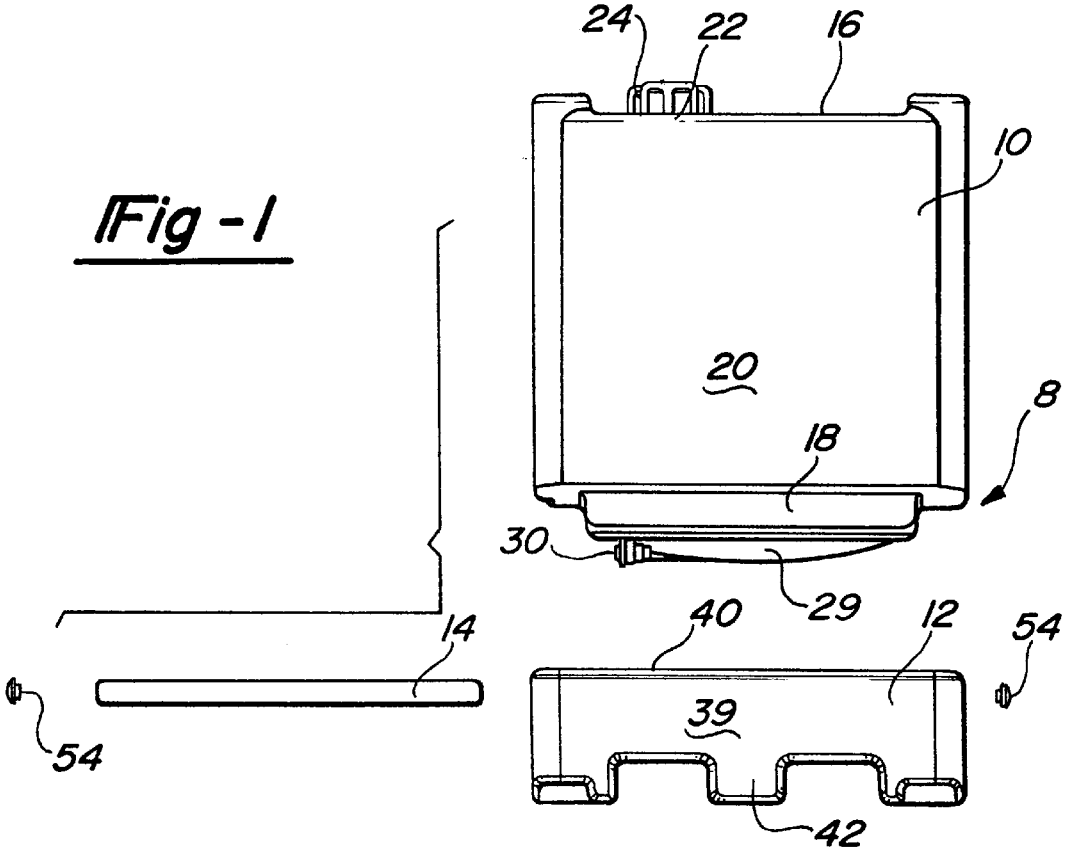
FIG. 1 is an exploded side view of the container of the present invention.

The container 8 of the present invention is shown in FIG. 1. In the preferred embodiment, the container 8 has a capacity of 330 gallons and is designed for holding bulk hazardous and non-hazardous liquids. The container consists generally of a tank member 10, a pallet 12 and two structural members 14 which hold the tank member 10 and the pallet 12 together during use of the container 8 to store and/or transport the bulk liquid in the tank member 10.

The tank member 10 is made of a polyethylene material in the preferred embodiment. Such a material is corrosion resistant. The tank member 10 has a bottom wall 18 and side walls 20. The poly material is stiff enough that the side walls 20 stand upright. In the preferred embodiment, there are four side walls 20, and the tank member 10 also has a top wall 16 which contains a fill port 22. The fill port 22 is gasket sealed and has a lid 24.

The tank member 10 of the present invention is designed to fully drain without tipping or any other action from the user. The bottom wall 18 of the tank member 10 is sloped to drain into a center sump 29 which is sloped toward a discharge port 30. In the preferred embodiment there are recessed areas 32 on the side walls 20. Each recessed area 32 has side walls 34 which are extensions of the side walls 20. The recessed area 32 is above the bottom wall 18. The discharge port 30 contains a valve (not shown) which is opened and closed to allow and disallow outward flow of the liquid stored in the tank member 10.

Figure 3:
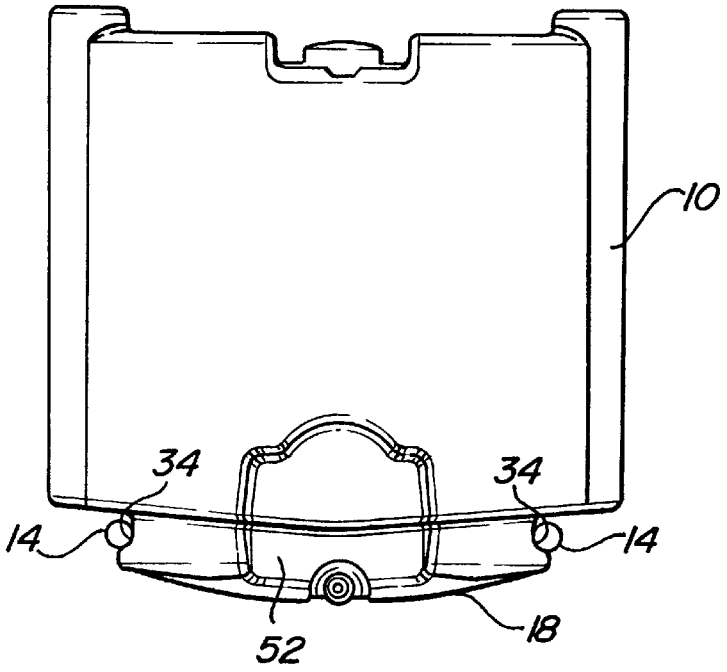
FIG. 3 is a front view of the tank member in the container of this invention.

The tank member 10 of the present invention interfits with the pallet 12. In the preferred embodiment this is accomplished by the provision of lifting surfaces 37 which extend laterally outward from two opposing side walls 34 (FIG. 3), which are extensions of the side walls 20. The lifting or tank retaining surfaces 37 are designed to interfit with the pallet 12.

Figure 6:
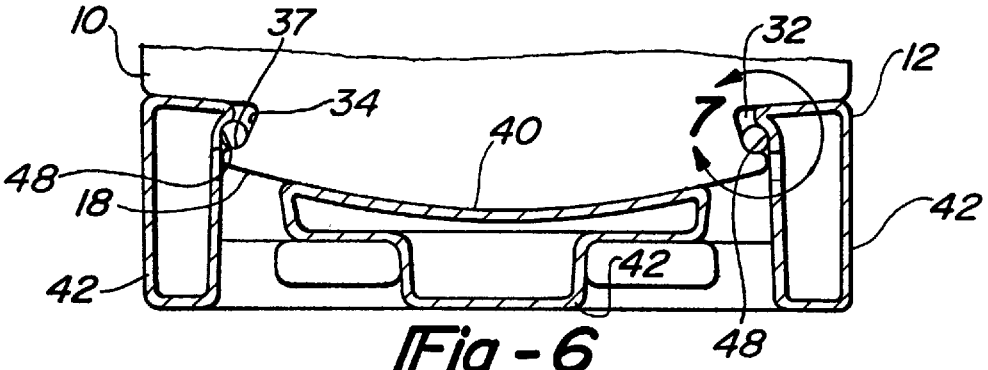
FIG. 6 is a fragmentary sectional view substantially along the line 6—6 in FIG. 4 showing the interfacing of the pallet, the tank and the structural members in the container of this invention.

The pallet 12 is made of a stiff polyethylene material in the preferred embodiment and is freestanding. The pallet 12 has an upper surface 40 (FIG. 6) which is concave and upon which the convex bottom wall 18 of the tank member 10 is removably mounted. In the preferred embodiment, when the tank member 10 is removably mounted on the pallet 12, the bottom wall 18 is in surface to surface contact with the upper surface 40 of the pallet 12 as shown in FIG. 6. The pallet 12 of the preferred embodiment has side walls 39 (FIG. 4) and feet 42 which rest upon a floor surface (FIG. 1). In the preferred embodiment, some of the feet 42 are located adjacent to side walls 39, and some are located in the center of the pallet 12.

Figure 2:
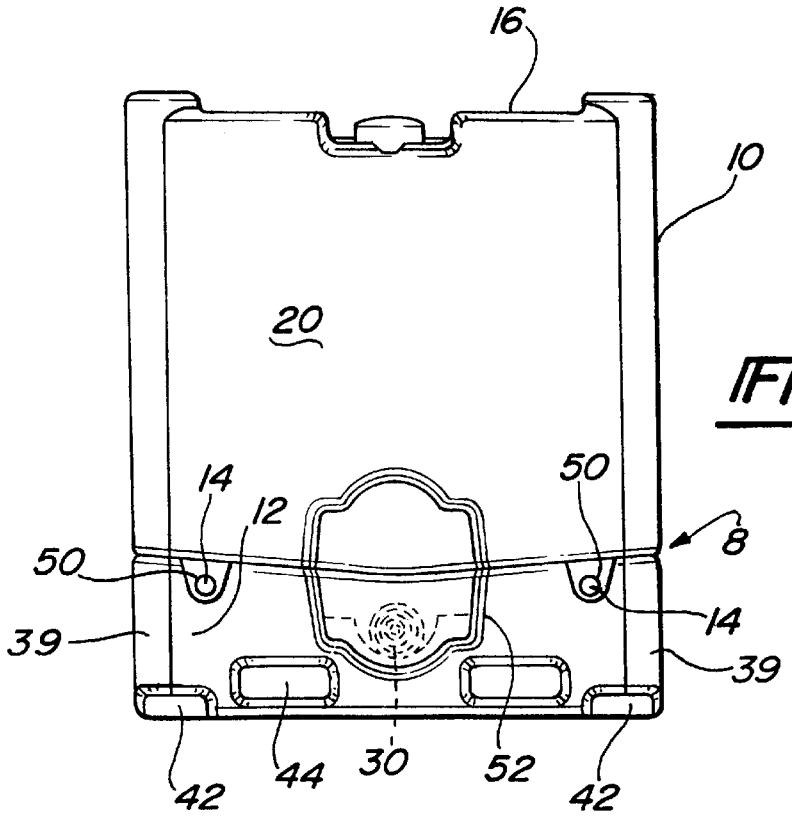
FIG. 2 is a front view of the container of the present invention.
Figure 7:
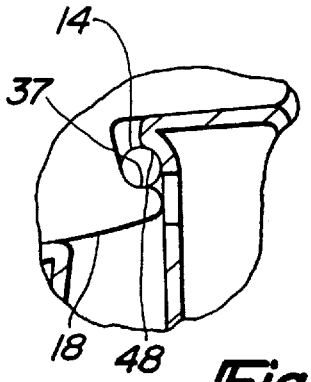
FIG. 7 is an enlarged fragmentary sectional view through the tank and pallet assembly showing the interfacing of the pallet, the tank and the structural members in the container of this invention.

In the preferred embodiment two side walls 39 have forklift pockets 44 (FIG. 2). The forklift pockets 44 are positioned to allow forklift tines to pass therethrough. Forklift access is possible from all side walls 39, as the feet 42 are positioned to allow access also on the side walls 39 without forklift pockets 44 as shown in FIG. 1. The pallet 12 is designed to interfit with the tank member 10 and has downwardly facing surfaces 48 (FIGS. 6 and 7) positioned in substantial vertical alignment with the surfaces 37. In the preferred embodiment the downwardly facing surfaces 48 are located in the center of two side walls 39.

In the preferred embodiment the pallet 12 also interfits with the discharge sump 29. The pallet 12 has a drain valley 46 (FIG. 4 and FIG. 5) which is positioned so that when the tank member 10 is removably mounted on the pallet 12, the sump 29 is located in the drain valley 46.

In the preferred embodiment a door 52 (FIG. 2) is attached to the upper portion of the side wall 39 corresponding to the discharge port 30 to also provide protection for the discharge port 30. The door 52 is hinged to swing down to cover the discharge port 30 and swing up as shown in FIG. 2 to allow access to the discharge port 30.

The pallet 12 has holes 50 (FIG. 2) through which the structural members 14 pass to engage the tank member 10 and the pallet 12. In the preferred embodiment there are four holes 50 located two each on two opposing side walls 39. The holes 50 are aligned with each other and with the spaces between the lifting surfaces 37 and the downwardly facing surfaces 48. The structural members 14 in the preferred embodiment are two straight pipes made of PVC, but the structural members 14 may be shaped differently and composed of different materials so long as the structural members 14 are able to hold together the tank member 10 and the pallet 12.

The container 8 is assembled by first placing the tank member 10 on the pallet 12 (FIG. 2). This is accomplished by tilting the tank member 10 enough to get the tank retaining surfaces 37 below the pallet retaining facing surfaces 48. At times this manipulation can best be done by having the tank member 10 and the pallet 12 on their sides.

Figure 4:
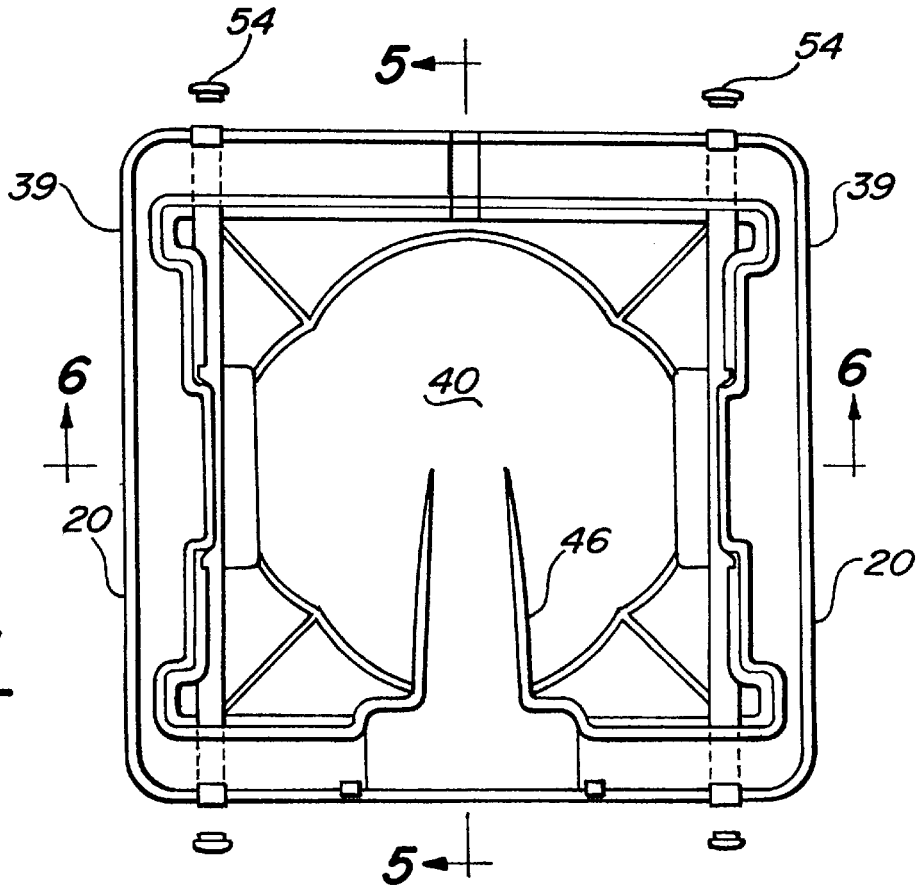
FIG. 4 is a top view of the pallet in the container of this invention.
Figure 5:
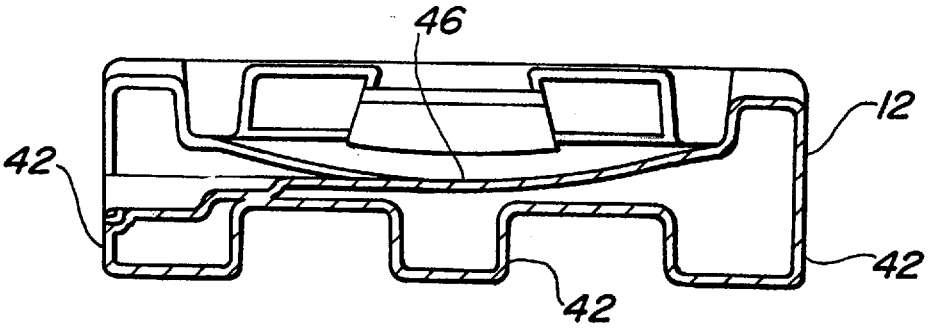
FIG. 5 is a sectional view as seen from substantially the line 5—5 in FIG. 4.

As the tank member 10 is removably mounted upon the pallet 12, the lifting surfaces 37 are positioned in substantial vertical alignment with the downwardly facing surfaces 48 (FIG. 6). The two structural members 14 (FIG. 4) are then pushed through the holes 50 in one of the side walls 39 of the pallet 12. The structural members 14 pass under the downwardly facing surfaces 48 located in the center of two of the side walls 39 and over the lifting surfaces 37 (FIG. 7) to the holes 50 in the opposite side wall 39 (FIG. 4). The lifting surfaces 37 (FIG. 7) are trapped beneath the structural members 14 when the structural members 14 are in place. The size of the structural members 14 insure a relatively close fit of structural members 14 with the lifting surfaces 37 and the downwardly facing surfaces 48.

In the preferred embodiment, four plugs 54 are then tap fitted into the holes 50 to hold the structural members 14 in place (FIG. 4). The four plugs 54 are made of a poly material and are corrosion resistant.

From the above description it is apparent that the present invention provides a poly container 8 comprised of a tank member 10 and a pallet 12 which are assembled easily for use and disassembled easily for maintenance and recycling. The two piece container 8 is economical as when the tank member 10 or the pallet 12 needs to be replaced, the container 8 is disassembled and only one part need be replaced. The poly material is corrosion resistant and requires little maintenance. The tank member 10 has lifting surfaces 37 which interfit with downwardly facing surfaces 48 on the pallet and two substantially straight structural members 14. The structural members 14 slide in the spaces between the lifting surfaces 37 and the downwardly facing surfaces 48 to hold the container 8 together.

It is to be understood that the invention is not limited to the exact construction illustrated and described above, but that various changes and modifications may be made without departing from the spirit and scope of the invention as defined in the following claims.

We claim:

1. A container for bulk liquids comprising:

a tank member having a bottom wall and side walls, said side walls having lifting surfaces extending outwardly in opposite directions, a pallet having an upper surface, said bottom wall on said tank member being removably mounted on said pallet upper surface, said pallet having downwardly facing surfaces in substantial vertical alignment with said lifting surfaces, said downwardly facing surfaces being spaced a predetermined distance above said lifting surfaces, and a pair of removably mounted structural members adjacent to said side walls positioned between and in substantial contact with said lifting surfaces and said downwardly facing surfaces so as to maintain said tank member on said pallet during movement of said container.

2. The container of claim 1 wherein said pallet has side walls, means in opposing ones of said side walls forming holes, and said structural members passing through said holes and through the spaces between said lifting surfaces and said downwardly facing surfaces.

3. The container of claim 1 wherein said structural members are two substantially straight pipes.

4. The container of claim 1 wherein said tank member has a top wall, said top wall having a fill port, and said tank member having a discharge port located in one of said side walls.

5. The container of claim 4 further including a sump in said bottom wall which is downwardly sloped to drain the contents of said tank member completely into said sump when said pallet is supported on a flat surface, said sump being sloped toward and communicating with said discharge port.

6. The container of claim 1 wherein said tank member has recessed areas on said side walls, said recessed areas having side walls which are extensions of said tank side walls, said recessed areas being adjacent to said tank bottom wall, and said lifting surfaces extending outwardly in opposite directions from said side walls on said recessed areas.

7. The container of claim 6 wherein said recessed areas are located completely within said pallet when said bottom wall of said tank member is removably mounted on said upper surface of said pallet.

8. A container for bulk liquids comprising:

a tank member, said tank member having a top wall, a bottom wall and side walls, said tank member having a fill port, said tank member having recessed areas on said side walls, said recessed areas having side walls recessed from said tank member side walls, said recessed area side walls having lifting surfaces extending outwardly in opposite directions, said recessed area having a sump and a discharge port located in one of said side walls;

a pallet, said pallet having side walls, said pallet having an upper surface, said tank member removably mounted on said upper surface with said recessed area fitting inside of said pallet, said pallet being shaped to interfit with said tank member, said pallet having a drain valley located beneath said sump, said pallet having downwardly facing surfaces, said downwardly facing surfaces being substantially vertically aligned with said lifting surfaces, said pallet having means forming holes located on said side walls;

a pair of elongated structural members, said structural members being shaped to fit through said holes, said structural members passing through said holes on said side walls, said structural members passing between said downwardly facing surfaces and said lifting surfaces, said structural members being in engagement with said surfaces so as to attach said tank member to said pallet; and maintain said tank member and said pallet in a connected together relationship.

9. The container of claim 8 wherein said structural members are straight pipes.

* * * * *